US007255598B2

(12) United States Patent
Montena et al.

(10) Patent No.: US 7,255,598 B2
(45) Date of Patent: Aug. 14, 2007

(54) COAXIAL CABLE COMPRESSION CONNECTOR

(75) Inventors: Noah Montena, Syracuse, NY (US); Jeremy Amidon, Marcelius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/346,756

(22) Filed: Feb. 3, 2006

(65) Prior Publication Data

US 2007/0042642 A1 Feb. 22, 2007

Related U.S. Application Data

(63) Continuation-in-part of application No. 11/180,757, filed on Jul. 13, 2005, now Pat. No. 7,021,965.

(51) Int. Cl.
*H01R 9/05* (2006.01)

(52) U.S. Cl. ..... 439/578; 439/585

(58) Field of Classification Search ..... 439/578, 439/585, 584

See application file for complete search history.

(56) References Cited

U.S. PATENT DOCUMENTS 6,102,738 A * 8/2000 Macek et al. ..... 439/584
6,558,194 B2 * 5/2003 Montena ..... 439/585
6,783,394 B1 * 8/2004 Holliday ..... 439/578
6,830,479 B2 * 12/2004 Holliday ..... 439/585
6,848,940 B2 * 2/2005 Montena ..... 439/584
6,905,365 B1 * 6/2005 Liu ..... 439/578
7,021,965 B1 * 4/2006 Montena et al. ..... 439/578
7,108,547 B2 * 9/2006 Kisling et al. ..... 439/578

* cited by examiner

*Primary Examiner*—Tho D. Ta
(74) *Attorney, Agent, or Firm*—Christopher R. Pastel; Pastel Law Firm

(57) ABSTRACT

A compression connector for a coaxial cable includes a unitary plastic body with a post connected inside the plastic body and a nut connected to the post. An O-ring seals the connection between the nut and the plastic body. A compression ring is connected to an outside of the plastic body. A reinforcing shield is also connected to the outside of the plastic body. The reinforcing shield serves to reinforce the plastic body when the compression ring is moved to its compressed position, so that softer plastics can be used for the plastic body. The reinforcing shield and compression ring also protect the entire outside of the plastic body from the environment.

6 Claims, 8 Drawing Sheets

COAXIAL CABLE COMPRESSION CONNECTOR

CROSS-REFERENCE TO RELATED APPLICATIONS

This application claims priority from and is a continuation in part of U.S. application Ser. No. 11/180,757 filed on Jul. 13, 2005 now U.S. Pat. No. 7,021,965 and entitled COAXIAL CABLE COMPRESSION CONNECTOR, incorporated by reference herein.

FIELD OF THE INVENTION

This invention relates generally to the field of coaxial cable connectors, and more particularly to a compression connector with a unitary plastic body having an exterior reinforcing shield.

BACKGROUND OF THE INVENTION

Coaxial cable is a typical transmission medium used in communications networks, such as a CATV network. The cables which make up the transmission portion of the network are typically of the "hard-line" type, while those used to distribute the signals into residences and businesses are typically "drop" connectors. The principal difference between hard-line and drop cables, apart from the size of the cables, is that hard-line cables include a rigid or semi-rigid outer conductor, typically covered with a weather protective jacket, that effectively prevents radiation leakage and protects the inner conductor and dielectric, while drop connectors include a relatively flexible outer conductor, typically braided, that permits their bending around obstacles between the transition or junction box and the location of the device to which the signal is being carried, i.e., a television, computer, and the like, but that is not as effective at preventing radiation leakage. Hard-line conductors, by contrast, generally span considerable distances along relatively straight paths, thereby virtually eliminating the need for a cable's flexibility. Due to the differences in size, material composition, and performance characteristics of hard-line and drop connectors, there are different technical considerations involved in the design of the connectors used with these types of cables.

In constructing and maintaining a network, such as a CATV network, the transmission cables are often interconnected to electrical equipment that conditions the signal being transmitted. The electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port without disrupting the ground connection of the cable. This requires a skilled technician to effect the interconnection.

A type of connector usable on cables is the compression type connector, such as is disclosed in U.S. Pat. No. 6,331,123. Compression connectors utilize a compression member that is axially slidable with relation to the connector body for radially displacing connecting and sealing members into engagement with the cable's outer conductor. A compression tool that slides the compression body into the connector is used by the technician to effect the connection, and due to the physical constraints of the compression member and connector body, it is impossible for the technician to use too much force to effect the interconnection. Thus, compression connectors eliminate the assembly drawbacks associated with threaded, and to some degree, crimp type connectors.

SUMMARY OF THE INVENTION

Briefly stated, a compression connector for a coaxial cable includes a unitary plastic body with a post connected inside the plastic body and a nut connected to the post. An O-ring seals the connection between the nut and the plastic body. A compression ring is connected to an outside of the plastic body. A reinforcing shield is also connected to the outside of the plastic body. The reinforcing shield serves to reinforce the plastic body when the compression ring is moved to its compressed position, so that softer plastics can be used for the plastic body. The reinforcing shield and compression ring also protect the entire outside of the plastic body from the environment.

According to an embodiment of the invention, a compression connector for a coaxial cable includes a unitary plastic body; a post connected inside the plastic body; a nut connected to the post; a compression ring connected to an outside of the plastic body; and a reinforcing shield, separate from the nut, connected to an outside of the plastic body, and wherein the reinforcing shield and compression ring protect the entire outside of the plastic body from the environment when the compression ring is in both a compressed position and an uncompressed position.

According to an embodiment of the invention, a method for making a compression connector includes the steps of: (a) forming a first sub-assembly by providing a unitary plastic body and connecting a compression ring to an outside of the plastic body; (b) forming a second sub-assembly by affixing a weather seal between a nut and a retaining ring; (c) connecting a post inside the second sub-assembly until a post flange of the post engages a nut flange of the nut; (d) placing an O-ring onto a capture portion of a reinforcing shield; and (e) connecting the first sub-assembly with the second sub-assembly.

According to an embodiment of the invention, a compression connector includes a unitary plastic body; means for connecting a post inside the plastic body; means for connecting a nut to the post; sealing means for sealing a connection between the nut and the plastic body; means for connecting a reinforcing shield to an outside of the plastic body, and means for connecting a compression ring to an outside of the plastic body; wherein the reinforcing shield and compression ring protect the entire outside of the plastic body from the environment when the compression ring is in both a compressed position and an uncompressed position.

DETAILED DESCRIPTION OF THE PREFERRED EMBODIMENT

Figure 1:
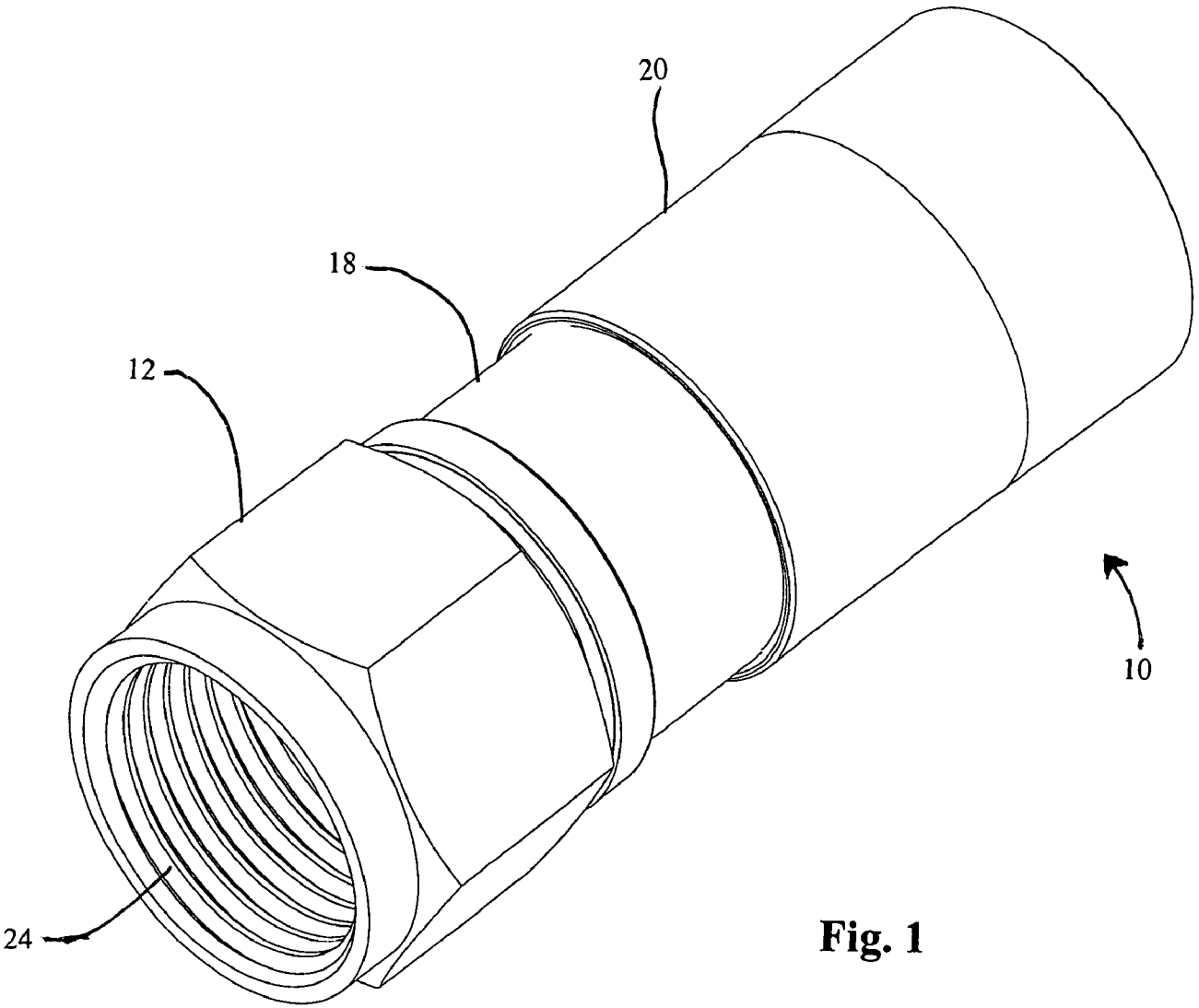
FIG. 1 shows a perspective view of a compression connector according to an embodiment of the invention.
Figure 2:
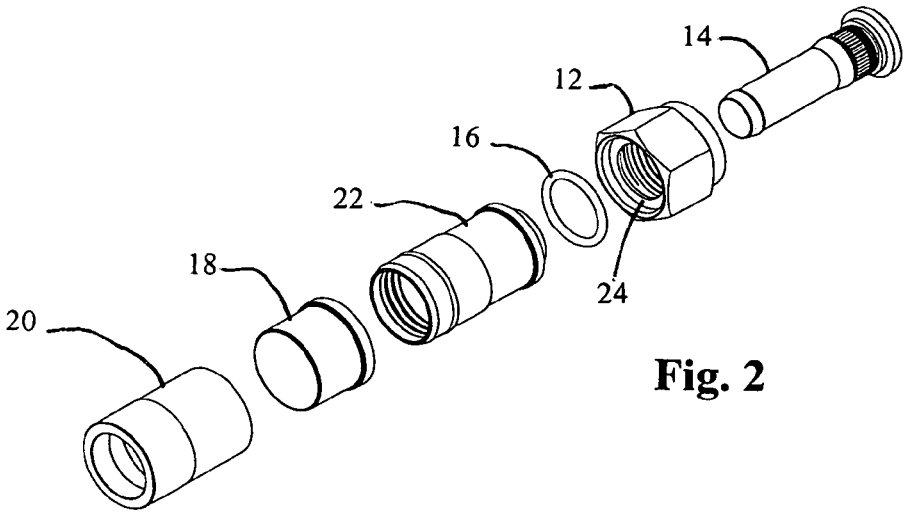
FIG. 2 shows an exploded view of the components of the compression connector of FIG. 1.
Figure 3:
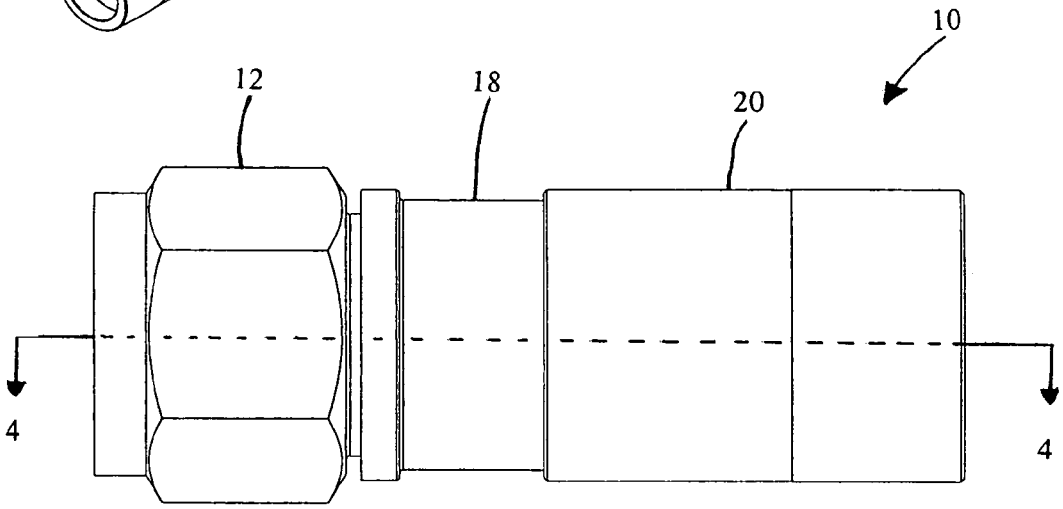
FIG. 3 shows a front elevation view of the compression connector of FIG. 1.

Referring to FIGS. 1-2, a coaxial cable compression connector 10 according to an embodiment of the invention is shown. A plastic body 22 is partly covered by a reinforcing shield 18 and partly covered by a compression ring 20. Compression ring 20 is preferably of metal but optionally is of plastic. A post 14 is disposed inside plastic body 22. A nut 12, preferably of metal for its conductive properties but optionally of plastic or composite material, is threaded with a thread 24 to permit connecting connector 10 to an equipment port or other device. An O-ring 16 preferably prevents moisture from entering connector 10 from the interface between nut 12, post 14, and plastic body 22.

Referring to FIGS. 3-8, additional details of connector 10 are shown. Shield 18 is held in place by shoulders 36 and 42 of plastic body 22. Plastic body 22 preferably includes a plurality of serrations 26, which, in conjunction with barbed tip 28 of post 14, provide a tight fit of the cable (not shown) and help to prevent moisture from entering connector 10 along the surface of the cable. After the end of the cable is prepared for installation, as is known by those skilled in the art of cable installation, the prepared cable end is inserted into end 40 of connector 10. Post 14 fits between the insulator core of the cable and the braided layer. Because plastic body 22 is of plastic, post 14 is preferably of a conductive material to form part of the electrical ground path from the cable braid to nut 12.

Because plastic body 22 is of plastic, it is susceptible to environmental damage from ultraviolet rays. The plastic is also susceptible to deformation from the forces imparted by compression ring 20 during cable installation, thus limiting the type of plastic used. Shield 18 is preferably metal but could be durable plastic or a composite material. Shield 18 protects plastic body 22 from the environment and also protects plastic body 22 from deformation resulting from compression ring 20, thus opening up a whole range of available plastic materials for use in making plastic body 22.

Shield 18 preferably includes a beveled edge 30 (FIG. 6) to prevent compression ring 20 from knocking shield 18 out of position while compression ring 20 is moved into position. Beveled edge 30 is preferably angled about 15 degrees from the horizontal. Plastic body 22 includes a beveled edge 38 to assist compression ring 20 in moving over plastic body 22 during assembly. Beveled edge 38 is preferably angled about 15 degrees from the horizontal. During assembly, compression ring 20 is moved over plastic body 22 until a beveled groove 34 in compression ring 20 snaps over a beveled stop 32 on plastic body 22.

Connector 10 is preferably assembled as follows. Shield 18 is snapped over plastic body 22. Then post 14 is inserted into nut 12. O-ring 16 is placed onto plastic body 22. Then the post 14 and nut 12 combination is moved into plastic body 22 until it engages with plastic body 22. Compression ring 20 is moved onto plastic body 22 until beveled groove 34 in compression ring 20 snaps over beveled stop 32. During cable installation, the prepared cable end is inserted through compression ring 20 into plastic body 22 so that the end of post 14 is engaged between the cable braid and the cable insulated core. Compression ring 20 is then forced onto plastic body 22 and part of metal shield 18 using a conventional compression tool until compression ring 20 is held tightly in place by the friction fit between the cable, compression ring 20, shield 18, plastic body 22, and post 14. The installation of connector 10 onto the cable is then complete.

Figure 4A:
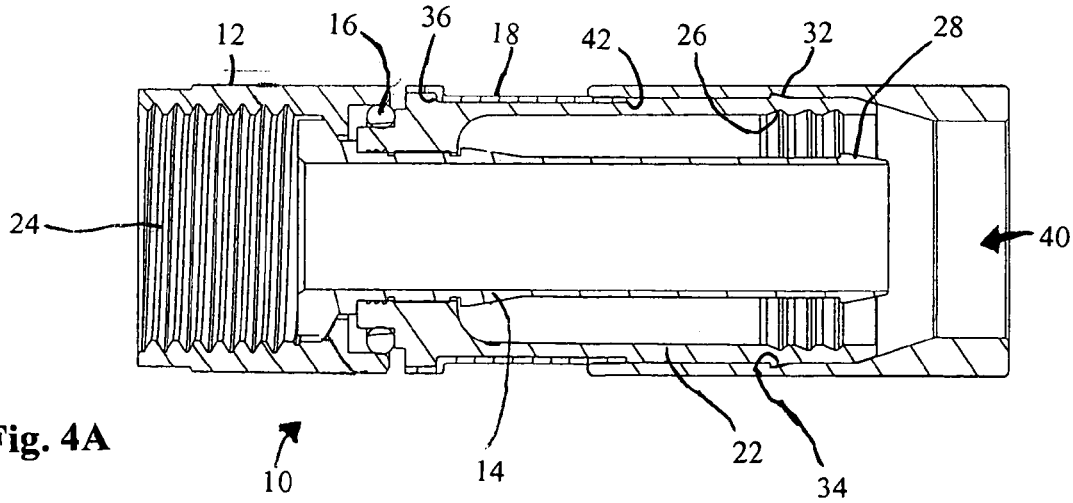
FIG. 4A shows a cross section of an embodiment of the compression connector of the present invention taken along the lines 4-4 in FIG. 3.
Figure 4B:
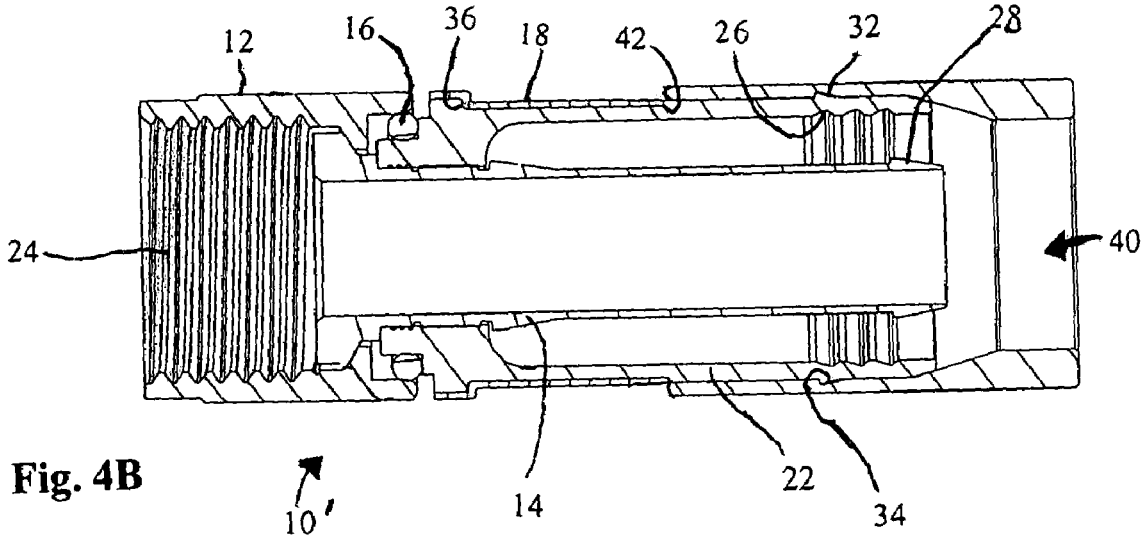
FIG. 4B shows a cross section of an embodiment of the compression connector of the present invention taken along the lines 4-4 in FIG. 3.
Figure 5:
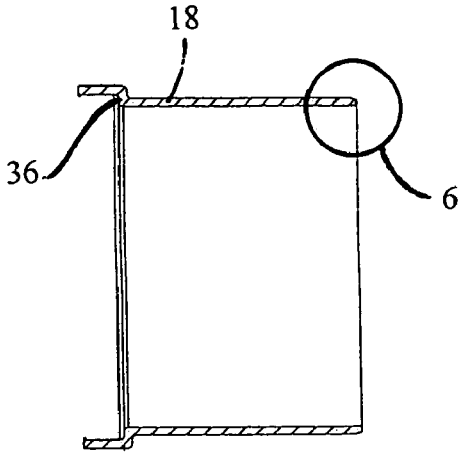
FIG. 5 shows a cross-sectional view of a metal shield according to an embodiment of the present invention.
Figure 6:
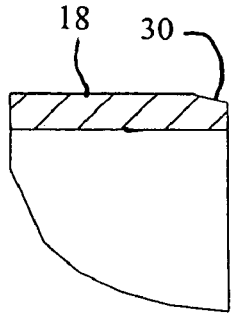
FIG. 6 shows an enlarged view of section 6 of FIG. 5.
Figure 7:
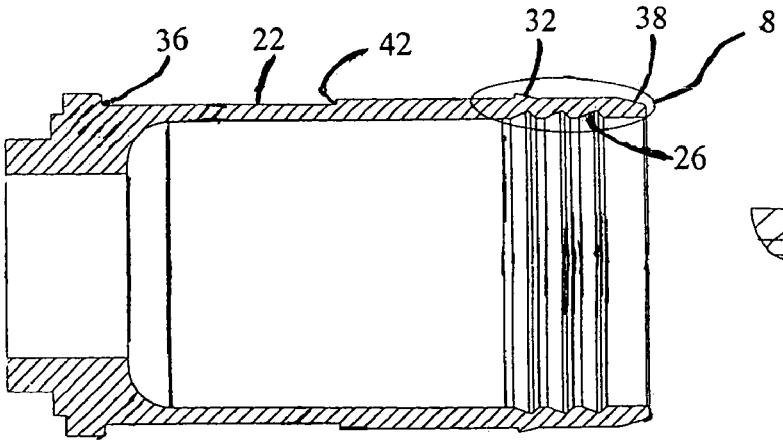
FIG. 7 shows a cross-sectional view of a unitary plastic body according to an embodiment of the present invention.
Figure 8:
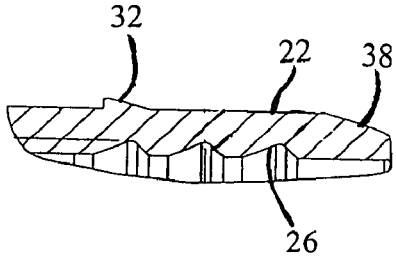
FIG. 8 shows an enlarged view of section 8 of FIG. 7.

In the embodiment of FIG. 4A, compression ring 20 overlaps shield 18 in the uncompressed position, while in the embodiment of FIG. 4B, compression ring 20 of compression connector 10' does not overlap shield 18 when in the uncompressed position. When in the compressed position, compression ring 20 overlaps shield 18 whether using the embodiment of FIG. 4A or the embodiment of FIG. 4B.

Figure 9:
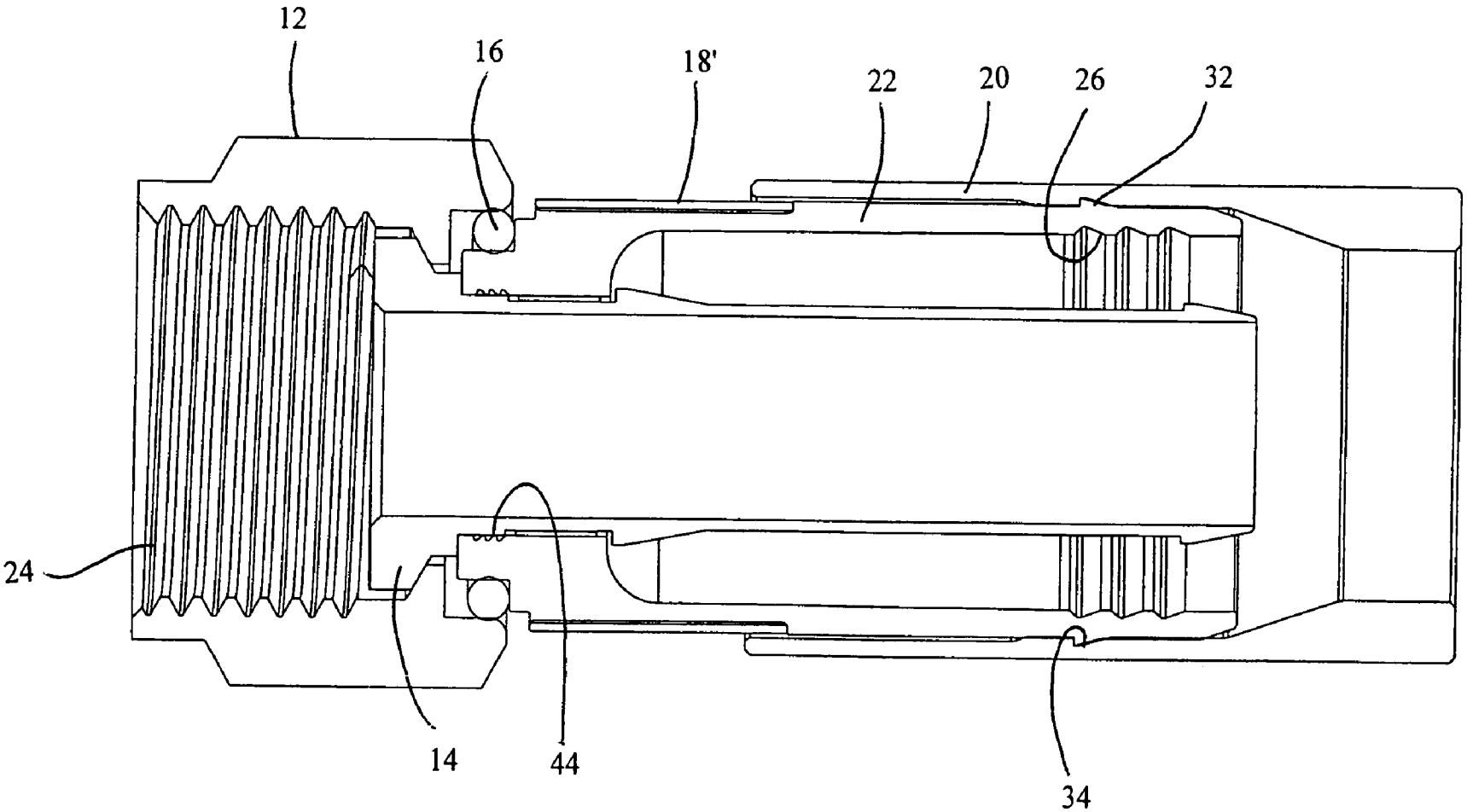
FIG. 9 shows a cross-sectional view of a compression connector according to an embodiment of the present invention.

Referring to FIG. 9, an embodiment of the invention is shown in which a connector 10' includes a shield 18' which does not include shoulder 36 (FIGS. 4A-4B), thus simplifying the manufacturing process. Note that this embodiment still includes a texturing or knurling 44 on body 22 which promotes frictional contact between post 14 and body 22.

Figure 10:
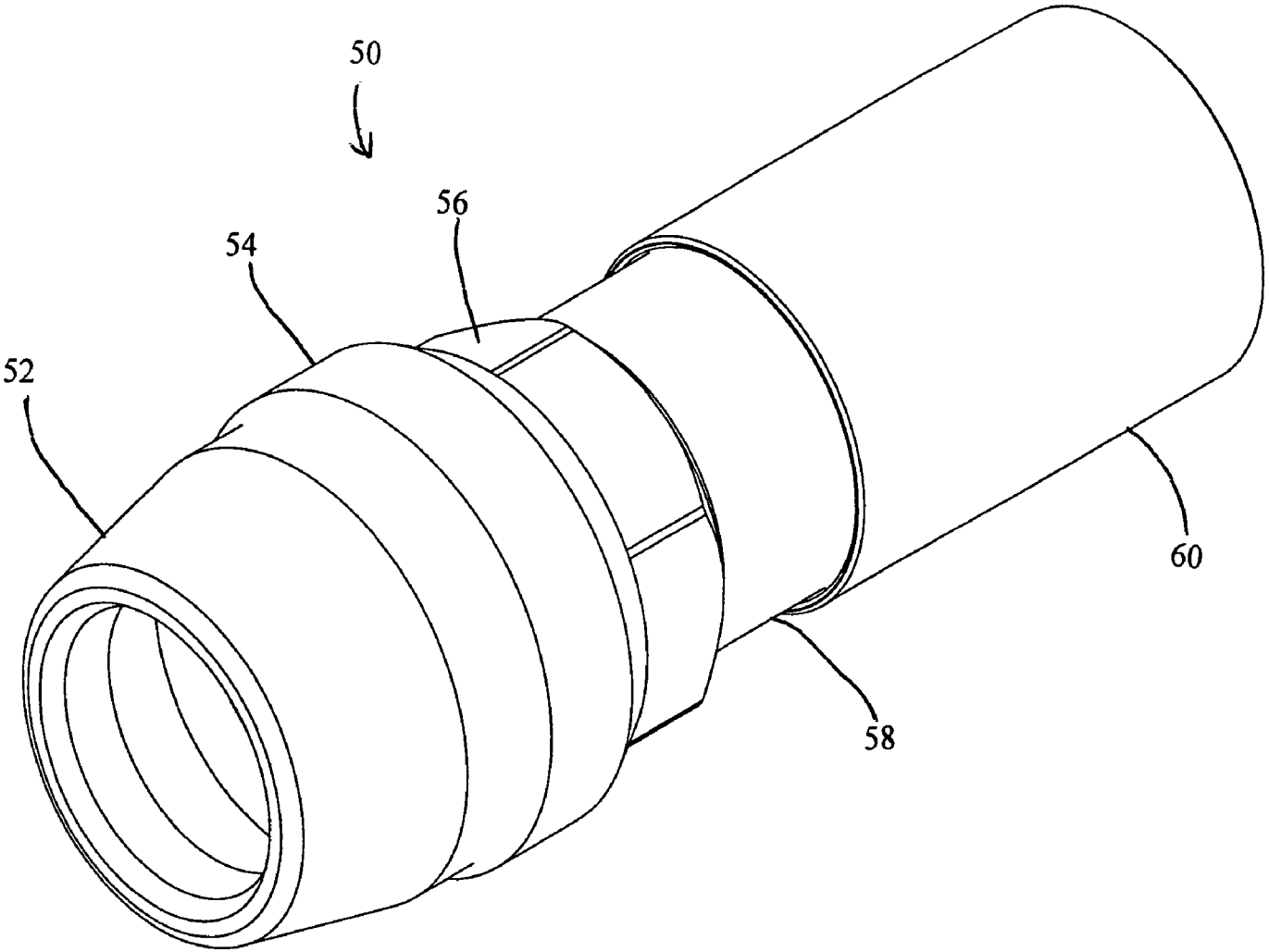
FIG. 10 shows a perspective view of a compression connector according to an embodiment of the invention.
Figure 11:
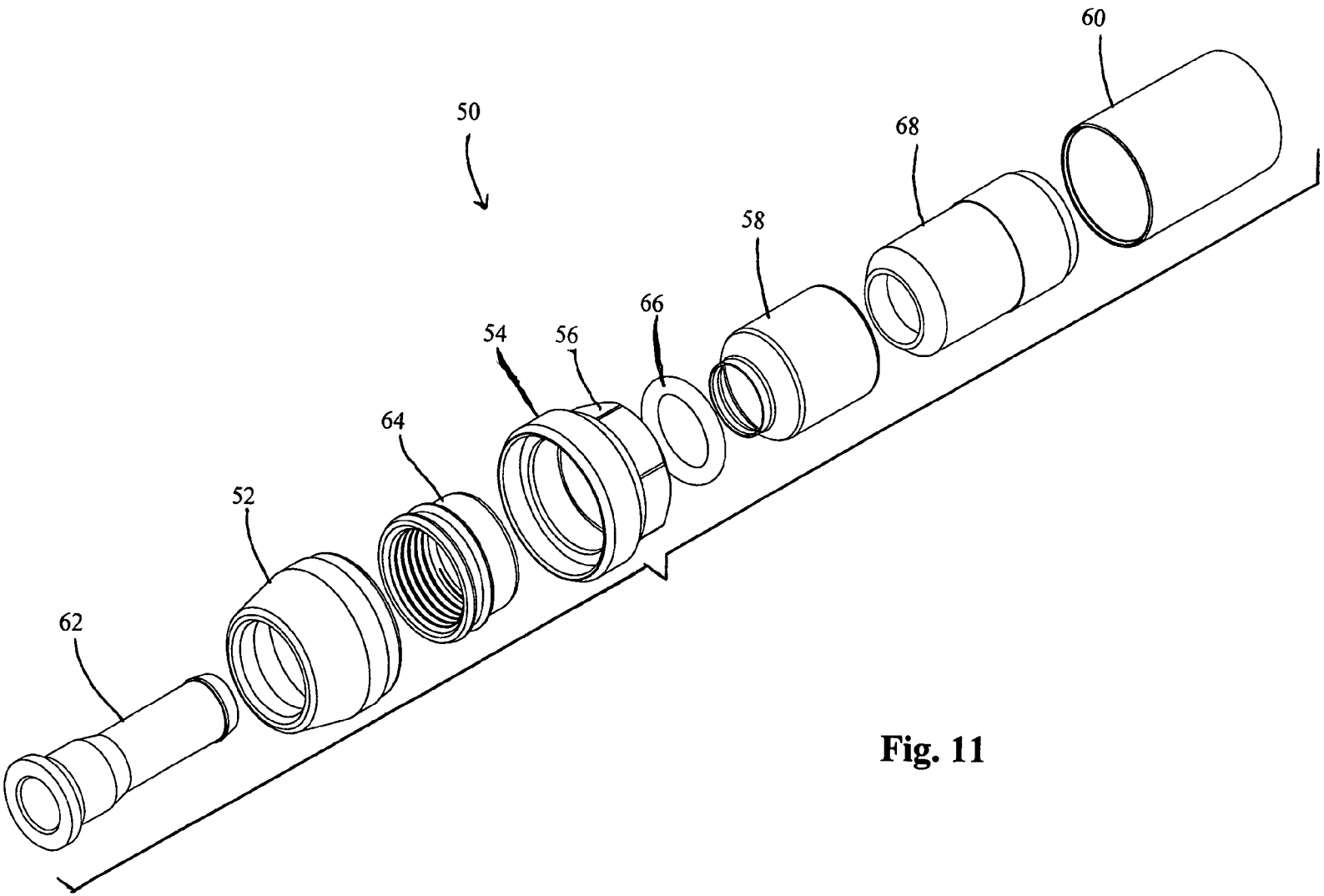
FIG. 11 shows an exploded view of the components of the compression connector of FIG. 10.
Figure 12:
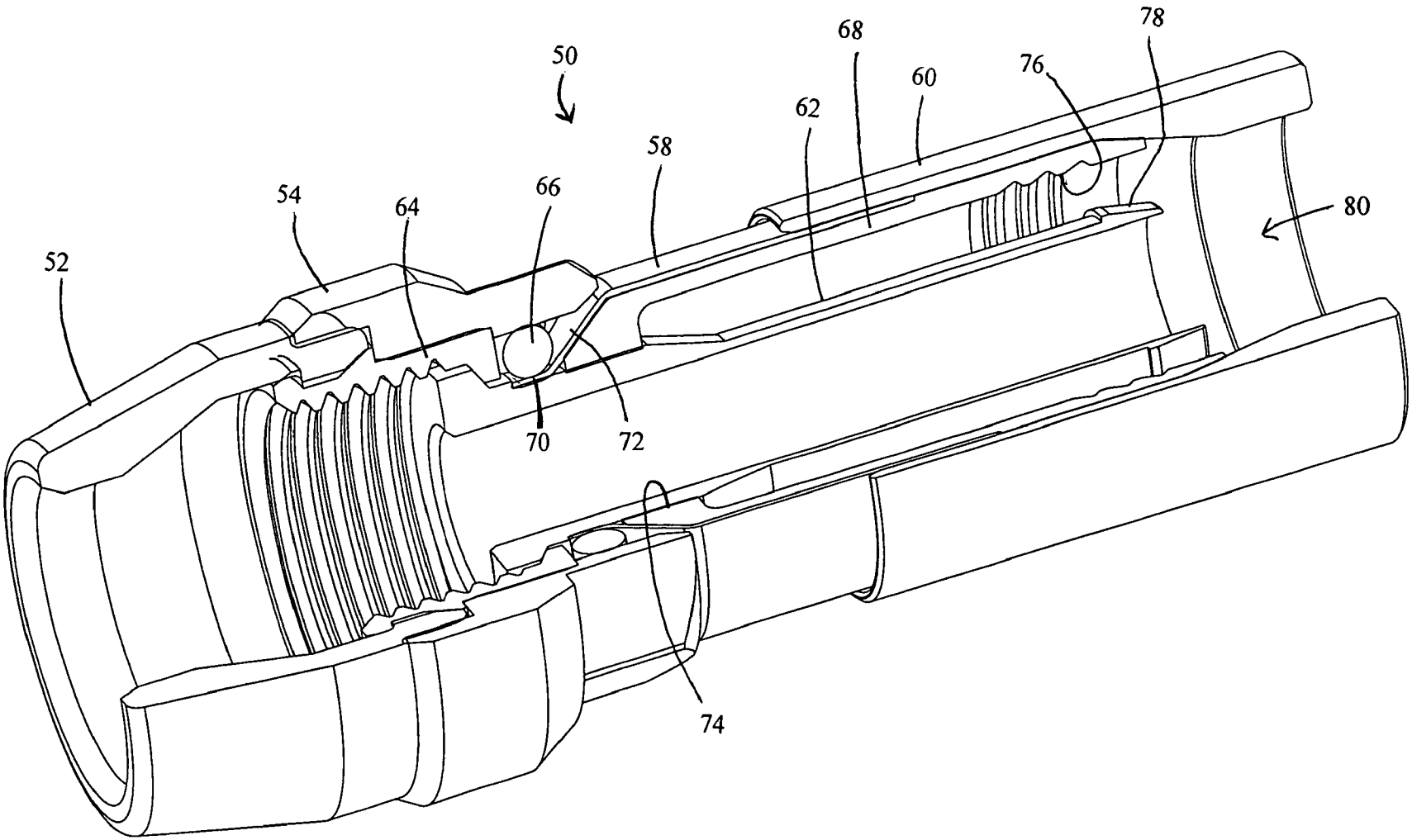
FIG. 12 shows a partial cutaway perspective view of the compression connector of FIG. 1.

Referring to FIGS. 10-12, according to an embodiment of the invention, a connector 50 is shown which includes a plastic body 68 partly covered by a reinforcing shield 58 and partly covered by a compression ring 60. Compression ring 60 is preferably of metal but optionally is of plastic. A post 62 is disposed inside plastic body 68. A nut 64, preferably of metal for its conductive properties but optionally of plastic or composite material, is threaded to permit connecting connector 50 to an equipment port or other device. A retaining ring 54, either of plastic or metal, cooperates with nut 64 to engage a weather seal 52. Retaining ring 54 preferably includes an integral wrench hex 56 to facilitate wrench tightening when fastening connector 50 onto the equipment port. An O-ring 66 preferably prevents moisture from entering connector 50 from the interface between nut 64, post 62, and plastic body 68.

Shield 58 is held in place by an interference fit with body 68. Plastic body 68 preferably includes a plurality of serrations 76, which, in conjunction with barbed tip 78 of post 62, provide a tight fit of the cable (not shown) and help to prevent moisture from entering connector 50 along the surface of the cable. After the end of the cable is prepared for installation, as is known by those skilled in the art of cable installation, the prepared cable end is inserted into end 80 of connector 50. Post 62 fits between the insulator core of the cable and the braided layer. When body 68 is of plastic, post 62 is preferably of a conductive material to form part of the electrical ground path from the cable braid to nut 64.

Because body 22 is preferably of plastic, it is susceptible to environmental damage from ultraviolet rays. The plastic is also susceptible to deformation from the forces imparted by compression ring 60 during cable installation, thus limiting the type of plastic used. Shield 58 is preferably metal but could be durable plastic or a composite material. Shield 58 protects body 68 from the environment and from deformation resulting from compression ring 60, thus opening up a whole range of available materials for use in making body 68. Shield 58 preferably includes a beveled edge as previously described in the earlier embodiments. Shield 58 also includes a snout 72 which includes a capture portion 70. Capture portion 70 fits under the inside diameter of O-ring 66 during assembly. The structural relationship between retaining ring 54, nut 64, post 62, and shield 58 permits O-ring 66 to have a relatively thick cross section. The interference fit between capture portion 70 and post 62 obviates the need for the knurling 44 (FIG. 9) in body 68, which instead has a smooth section 74, which facilitates inserting post 62 into the coaxial cable during installation, as well as removing a manufacturing step.

Connector 50 is preferably assembled as follows. Body 68 is press fitted into shield 58 to form a first sub-assembly, while weather seal 52 is affixed between nut 64 and retaining ring 54 to form a second sub-assembly. Then post 62 is inserted into the second sub-assembly until the flange of post 62 engages the flange of nut 64. O-ring 66 is placed onto capture portion 70 of shield 58, after which the first sub-assembly is pushed into the second sub-assembly until it stops.

During cable installation, the prepared cable end is inserted through compression ring 60 into body 68 so that the end of post 62 is engaged between the cable braid and the cable insulated core. Compression ring 60 is then forced onto body 68 and part of metal shield 58 using a conventional compression tool until compression ring 60 is held tightly in place by the friction fit between the cable, compression ring 60, shield 58, body 68, and post 62. The installation of connector 50 onto the cable is then complete.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A compression connector for a coaxial cable, comprising:

a unitary plastic body;

a post connected inside the plastic body;

a nut connected to the post;

a compression ring connected to an outside of the plastic body; and a reinforcing shield, separate from the nut, connected to an outside of the plastic body, and wherein the reinforcing shield and compression ring protect the entire outside of the plastic body from the environment when the compression ring is in both a compressed position and an uncompressed position, wherein the reinforcing shield includes a snout, and the snout includes a capture portion which fits between the post and an O-ring.

2. A compression connector according to claim 1, further comprising:

a retaining ring; and a weather seal, wherein a portion of the weather seal is fitted between the retaining ring and the nut.

3. A method for making a compression connector, comprising the steps of:

forming a first sub-assembly by providing a unitary body having an outside surface and mounting a reinforcing shield to the outside surface;

forming a second sub-assembly by affixing a weather seal between a nut and a retaining ring;

connecting a post inside the second sub-assembly until a post flange of the post engages a nut flange of the nut;

placing an O-ring onto a capture portion of the reinforcing shield;

connecting the first sub-assembly with the second sub-assembly; and connecting a compression ring to an outside of a portion of the first sub-assembly.

4. A method according to claim 3, wherein the reinforcing shield and compression ring protect the entire outside of the plastic body from the environment.

5. A compression connector; comprising:

a unitary plastic body;

means for connecting a post inside the plastic body;

means for connecting a nut to the post;

sealing means for sealing a connection between the nut and the plastic body;

means for connecting a reinforcing shield to an outside of the plastic body, and means for connecting a compression ring to an outside of the plastic body;

wherein the reinforcing shield and compression ring protect the entire outside of the plastic body from the environment when the compression ring is in both a compressed position and an uncompressed position; and wherein the reinforcing shield includes a snout, and the snout includes a capture portion which fits between the post and the sealing means.

6. A compression connector according to claim 5, further comprising:

a retaining ring; and a weather seal, wherein a portion of the weather seal is fitted between the retaining ring and the nut.

* * * * *